US006825274B2

(12) United States Patent
Djiauw et al.

(10) Patent No.: US 6,825,274 B2
(45) Date of Patent: Nov. 30, 2004

(54) MELT PROCESSABLE, BLEACH RESISTANT, DURABLE FIBERS HAVING HIGH ELASTIC RECOVERY AND LOW STRESS RELAXATION FROM POLYURETHANE ELASTOMERS

(75) Inventors: Lie Khong Djiauw, Houston, TX (US); Michael A. Masse, Katy, TX (US)

(73) Assignee: KRATON Polymers U.S. LLC, Houston, TX (US)

( * ) Notice: Subject to any disclaimer, the term of this patent is extended or adjusted under 35 U.S.C. 154(b) by 127 days.

(21) Appl. No.: 10/347,910

(22) Filed: Jan. 21, 2003

(65) Prior Publication Data

US 2003/0162910 A1 Aug. 28, 2003

Related U.S. Application Data

(62) Division of application No. 10/019,626, filed as application No. PCT/EP00/06046 on Jun. 28, 2000, now Pat. No. 6,537,661.

(60) Provisional application No. 60/142,143, filed on Jul. 2, 1999.

(51) Int. Cl.[7] ..... C08G 18/32; C08G 18/62

(52) U.S. Cl. ..... 525/131; 528/75; 528/85

(58) Field of Search ..... 525/131; 528/75, 528/85

(56) References Cited

U.S. PATENT DOCUMENTS

| | | | | |
|---|---|---|---|---|
| 2,929,804 A | | 3/1960 | Steuber | |
| 4,970,259 A | | 11/1990 | Mitchell et al. | |
| 5,039,755 A | | 8/1991 | Chamberlain et al. | |
| 5,093,422 A | | 3/1992 | Himes | |
| 5,376,745 A | | 12/1994 | Handlin, Jr. et al. | |
| 5,391,637 A | | 2/1995 | Willis et al. | |
| 5,391,663 A | | 2/1995 | Bening et al. | |
| 5,393,843 A | | 2/1995 | Handlin, Jr. et al. | |
| 5,405,911 A | | 4/1995 | Handlin, Jr. et al. | |
| 5,416,168 A | | 5/1995 | Willis et al. | |
| 5,418,296 A | | 5/1995 | Willis et al. | |
| 5,666,960 A | | 9/1997 | Fredberg et al. | |
| 5,925,724 A | * | 7/1999 | Cenens et al. | 528/85 |
| 5,929,167 A | | 7/1999 | Gerard et al. | |
| 5,955,559 A | | 9/1999 | Handlin, Jr. et al. | |

FOREIGN PATENT DOCUMENTS

| | | |
|---|---|---|
| JP | 11-131325 | 8/1999 |
| WO | 97/00901 | 1/1997 |

* cited by examiner

*Primary Examiner*—Patricia A. Short

(57) ABSTRACT

The present invention provides melt processable, bleach resistant durable fibers having an elastic recovery above 50% after extension to 160% elongation and a stress relaxation below 50% after extension to 150% for 30 minuets which are formed from a soft polyurethane elastomer. This elastomer is comprised of (a) from 75 to 90% weight of a polydiene diol having up to about two terminal hydroxyl groups per molecule and a number average molecular weight between 500 and 20,000, (b) from 9 to 25% weight of a diisocyanate, and (c) from 0.8% to 5% weight of a chain extender which is a low molecular weight aliphatic diol, or a mixture of the low molecular weight aliphatic diol and from 0.1 to 4.0 mol % of a diamine wherein the hard segment content of the polyurethane elastomer is from about 10 to about 30% weight. The present invention further provides a polyurethane elastomer.

10 Claims, No Drawings

MELT PROCESSABLE, BLEACH RESISTANT, DURABLE FIBERS HAVING HIGH ELASTIC RECOVERY AND LOW STRESS RELAXATION FROM POLYURETHANE ELASTOMERS

CROSS REFERENCE TO RELATED APPLICATIONS

This application is a divisional of U.S. patent application Ser. No. 10/019,626, filed Feb. 20, 2002, now U.S. Pat. No. 6,537,661, which is a 371 of PCT/EP00/06046, filed Jun. 28, 2000, and claims the benefit of U.S. provisional patent application Ser. No. 60/142,143, filed Jul. 2, 1999.

FIELD OF THE INVENTION

This invention relates to melt processable, bleach resistant durable fibers; and to polyurethane elastomers from which such fibers are formed.

BACKGROUND OF THE INVENTION

Melt processable elastomeric compositions which are easily compression moulded or melt blown into elastic fibers or films having low stress relaxation, low hysteresis, and high recoverable energy and made from hydrogenated polystyrene-polybutadiene-polystyrene block copolymers are described in U.S. Pat. Nos. 4,970,259 and 5,093,422. The elastic fibers and films described in these patents are useful in a variety of applications such as diaper waistbands and non-woven fabrics. Such applications are non-durable fiber applications and are so described because they do not require the retention of properties at relatively high service temperatures, such as 50 to 60° C., and they do not require an exceedingly high elastic recovery. Further, the articles constructed from them are designed for short-term use. While hydrogenated styrenic block copolymers are useful in short-term and disposable applications, their low upper service temperatures limit their long-term use in reusable, washable fabrics. The chemical composition of the rubbery section of styrenic block copolymers does offer outstanding resistance to oxidative and hydrolytic environments. Common durable fibers such as polyurethane, polyurethane-urea and polyester fibers generally have good upper service temperatures such that they are suitable for durable applications. They are, however, susceptible to oxidation and hydrolysis. Further, polyurethane-urea, or spandex, fibers are not melt processable and so must be spun from solutions employing costly solvents.

Currently, the material most often used for a durable elastic fiber for fabrics used in athletic-wear and swimwear applications is spandex. The usual definition of spandex is a fiber made from polyether polyols, diisocyanates, and diamines to form a segmented polyurethane-urea. The polyurethane-urea has "soft segments" and "hard segments," which refer to specific portions of the polymer chain. The soft segments are the portions of the spandex polymer chain that can be derived from the polyether polyols. The hard segments are the portions of the spandex polymer chain that are derived from the reaction of an isocyanate and a diamine or diol chain extender. Spandex polymers and their method of manufacture are described in U.S. Pat. No. 2,929,804 from DuPont. In another DuPont spandex patent, U.S. Pat. No. 5,666,960, spandex fibers are said to be known to be detrimentally affected by exposure to chlorinated water, as for example in swimming pools.

Commercially available spandex fibers are generally made from poly(tetramethylene ether)glycol, methylene-bis (4-phenylisocyanate), and an amine such as ethylene diamine. Fibers made from spandex are not melt processable because of the chemical composition of the reactant with the amine chain extender. It becomes a thermoset resin which is not melt processable. Therefore, spandex fibers are made by solution spinning. This is a very tedious and expensive process which requires a solvent such as dimethylacetamide which itself is expensive and the cost of its recovery is also expensive. Melt processing techniques for making fibers are much simpler and much easier to carry out and also are much less expensive.

It can be seen that it would be highly advantageous if there was a way to manufacture a durable fiber which had the characteristics of spandex fibers but could be melt processed. It would also be advantageous to be able to produce a durable fiber which was not susceptible to attack by chlorine such as in bleach and was resistant to hydrolysis. The present invention provides such a durable fiber.

SUMMARY OF THE INVENTION

The present invention provides melt processable, bleach resistant durable fibers having an elastic recovery above 50% after an extension to 160% elongation and a stress relaxation below 50% after an extension to 150% for 30 minutes which are formed from a (soft) polyurethane elastomer. This elastomer is comprised of (a) from 75 to 90% weight of a polydiene diol having up to about two terminal hydroxyl groups per molecule and a number average molecular weight between 500 and 20,000, (b) from 9 to 25% weight of a diisocyanate, (c) from 0.8 to 5% weight of a chain extender which is a low molecular weight aliphatic diol, or a mixture of the low molecular weight aliphatic diol and from 0.1 to 4.0 mol % of the total amount of chain extender, i.e. the mixture, of a diamine wherein the hard segment content of the polyurethane elastomer is from about 10 to about 30% weight. Such chain extenders will have not more than two functional groups which will react with the diisocyanate and have a number average molecular weight from 40 to 600 and a hydroxyl equivalent weight of 20 to 300 grams per hydroxyl group. Preferably, the chain extender is a linear aliphatic diol having 2 to 40 carbon atoms and is more preferably selected from the group consisting of ethylene glycol, 1,3-propane diol, 1,4-butane diol, 1,5-pentane diol, and 1,6-hexane diol. The hard segment contents can be calculated according to equation 1.

$$\text{Hard segment content}=100*(\text{isocyanate mass}+\text{chain extender mass})/(\text{total mass}) \quad (1)$$

According to a further aspect the present invention relates to a polyurethane elastomer comprised of (a) from 75 to 90% weight, basis the total of (a), (b) and (c), of a polydiene diol having up to about two terminal hydroxyl groups per molecule and a number average molecular weight between 1000 and 20,000, (b) from 9 to 25% weight, basis the total of (a), (b) and (c), of a diisocyanate, and(c) from 0.8 to 5% weight, basis the total of (a), (b)and (c), of a chain extender which is a mixture of a lowmolecular weight aliphatic diol and from 0.1 to 4.0 mol %, basis the total mixture, of a diamine, wherein the hard segment content of the polyurethane elastomer is in the range from about 10 to about 30% weight.

DETAILED DESCRIPTION OF THE INVENTION

As discussed above, the hydrogenated styrene-butadiene-styrene block copolymers that are used to make elastic fibers do not allow the retention of properties at high service temperatures and also they do not stretch and recover well enough for durable fiber applications. Spandex is the industry standard for durable elastic fibers but spandex fibers are not melt processable and are expensive to manufacture and they also are not bleach resistant. The polyurethane elastomeric fibers of the present invention are not thermosets so they are melt processable and thus have that advantage over spandex fiber. Furthermore, the polyurethane elastomeric fibers of the present invention are resistant to chlorine bleach which is highly advantageous since it is desirable to wash such fibers in bleach from time to time. The polyurethane elastomeric fibers of the present invention equal spandex fibers in terms of their elastic recovery and stress relaxation properties and the retention of strength properties at higher service temperatures, up to 100° C., is very good.

The film and fiber products designed for durable applications, such as in textile garment, industrial uses need to meet several performance criteria. Among these, the products should exhibit excellent elastic performance (high strength, high hysteresis recovery, low stress relaxation) at use temperature. The products should retain their integrity and elastic performance after passing hot water and hot cleaner dryer cycles. In addition, the products also need to have sufficient retention of properties upon exposure to various chemicals, such as bleach, acid, and cleaning solvents. To have good consumer appeal, the product should be able to colour upon dyeing with dyestuff.

The term "elastic" is used herein to mean any material which, upon application of a tensile force, is stretchable, that is, elongatable at least about 60 percent (i.e., to a stretched, length which is at least about 160 percent of its relaxed length) and which will recover at least 55 percent of its elongation upon release of the stretching, elongating force. A hypothetical example would be a one inch (2.54 cm) sample of a material which is elongatable to at least 1.60 inches (4.06 cm) and which, upon being elongated to 1.60 inches (4.06 cm) and released, will recover to a length of not more than 1.27 inches (3.23 cm). Many elastic materials may be elongated by much more than 60 percent (i.e., much more than 160 percent of their relaxed length), for example, elongated 100 percent or more, and many of these will recover to substantially their initial relaxed length, for example, to within 105 percent of their initial relaxed length, upon release of the stretching force.

As used herein, the term "stress relaxation" refers to the percent loss of tension or load between the maximum load or force encountered after elongating an elastic material at a specified rate of extension to a predetermined length (or the load or force measured at some initial length) and the remaining load or force measured after the sample has been held at that length for a specified period of time, for example, from about 0 minutes to about 30 minutes. Except where otherwise noted for the present invention, stress relaxation is expressed as a percentage loss of the initial load encountered at a specified extension of an elastic material. The stress relaxation is determined by calculating the difference between the initial load measured after elongating an elastic material at a rate of 20 inches per minute (50.8 cm/min) to an elongation of 160 percent (i.e., to 260 percent of the material's initial length) and the remaining load measured after that sample was held at that length for 30 minutes and dividing that difference by the initial load at that length. Testing may be performed on an Instron Model 5565 Universal Test Machine using ASTM micro tensile specimens. Stress relaxation after 30 minutes at, for example, an elongation of 160 percent (i.e., to 260 percent of the material's initial length) may be expressed as a percentage utilizing the following equation:

stress relaxation=(initial load 160%−load 160%@30 min)/(initial load 160%)*100.

As used herein, the term "recoverable energy" refers to the energy stored by an elastic material when it is elongated to a specified length. Recoverable energy is measured utilizing a tensile testing apparatus such as, for example, an Instron Model 1122 Universal Test Machine, by elongating a sample of an elastic material sample at 1 inch/minute (2.54 cm/min) to 150 percent elongation (i.e., to 250 percent of the material's initial relaxed length) and cycling back to zero load for 1 hysteresis loop. The percent recoverable energy is determined by dividing the area under the retraction curve of the first hysteresis loop by the area under the elongation curve of the first hysteresis loop and then multiplying by 100.

As used herein, the terms "set" or "percent set" refer to the deformation of an elastic material measured while the material is in a relaxed condition immediately after the material was released from a specified elongation without allowing the material to snap back. The percent set is determined by dividing the zero load extension after 1 cycle by the initial sample gauge length, and then multiplying by 100. The zero load extension is the distance that the jaws of the tensile test equipment move at the beginning of the second cycle before a load is registered by the tensile test equipment. The set may be measured utilizing a tensile testing apparatus such as, for example, an Instron Model 1122 Universal Test Machine, by elongating a sample of an elastic material at 1 inch/minute (2.54 cm/min) to 150 percent elongation and cycling back to zero load for 1 hysteresis loop.

Polyurethanes are generally composed of an isocyanate compound, a polyol, and a chain extender. A broad spectrum of properties can be achieved by varying the type and amount of each of these components. The diisocyanate is often an aromatic compound and the chain extender is a low molecular weight diol or diisocyanate. The present invention uses a polydiene diol as the polyol to achieve novel properties.

Polyurethane compositions made with polydiene diols, diisocyanates, and certain diol chain extenders are described in WO 97/00901, which is herein incorporated by reference. The compositions described therein contained chain extenders which were low molecular weight diols. The purpose of the reinforcing diols therein and herein is to increase the level of hard segment (the amount of isocyanate plus the amount of reinforcing diol) in the polyurethane composition and thus to make it harder and stronger.

In polyurethanes of this type, it is necessary that there be a hard segment and a soft segment. The strength of the polyurethane derives from the hard segments. Further, the hard segments must aggregate in crystalline or glassy domains in order to provide the physical crosslinking need for strength. Thus, the soft and hard segments must be incompatible in the final polymer. Generally, the hard segment content is chosen to achieve a balance of hardness, strength, and flexibility. These properties depend upon the degree of incompatibility in the final polymer. For a given hard segment content the degree of compatibility will vary depending upon the composition of the polyol, diisocyanate and chain extender. In the limiting case of good compatibility between a 11 components no phase separation takes place at any hard segment content and therefore no strength mechanism exists. Conversely, when the components are extremely incompatible even mixing of the constituent compounds cannot be done and the polymer is not formed. The desired case is a suitable balance of compatibility/incompatibility which allows nearly complete phase separation at low hard segment content. In this case, soft, strong elastomeric polyurethanes can be formed.

The polydiene diols used in this invention are prepared anionically such as described in U.S. Pat. Nos. 5,376,745, 5,391,663, 5,393,843, 5,405,911, and 5,416,168, which are incorporated by reference herein. The polydiene diols preferably have from 1.6 to 2, more preferably from 1.8 to 2, and most preferably from 1.9 to 2 terminal hydroxyl groups per molecule, and a number average molecular weight in the range from 1000 to 20,000, more preferably from 1500 to 10,000. The polydiene diols typically have hydroxyl equivalent weights between about 500 and about 10,000, preferably between 750 and 5,000 (hydroxyl equivalent weight is about half because its a diol). Hydrogenated polybutadiene diols are preferred and these preferably have 1,2-addition between 30% and 70% to minimize viscosity.

The polybutadiene polymer preferably will have no less than about 40% 1,2-butadiene addition because, after hydrogenation, the polymer will be a waxy solid at room temperature if it contained less than about 40% 1,2-butadiene addition. To minimize viscosity of the diol, the 1,2-butadiene content is most preferably in the range from about 40 to about 60%. A polyisoprene diol polymer should preferably have no less than 80% 1,4-isoprene addition in order to reduce Tg and viscosity. The diene microstructures are typically determined by 13 C nuclear magnetic resonance (NMR) in chloroform.

Polymerization of the polydiene diols commences with a monolithium or dilithium initiator that builds a living polymer backbone at each lithium site. The conjugated diene is typically 1,3-butadiene or isoprene. The anionic polymerization is done in solution in an organic solvent, typically a hydrocarbon like hexane, cyclohexane or benzene, although polar solvents such as tetrahydrofuran can also be used. When the conjugated diene is 1,3-butadiene and when the resulting polymer will be hydrogenated, the anionic polymerization of butadiene in a hydrocarbon solvent like cyclohexane is typically controlled with structure modifiers such as diethylether or glyme (1,2-diethoxyethane) to obtain the desired amount of 1,4-addition. The optimum balance between low viscosity and high solubility in a hydrogenated polybutadiene polymer occurs in the range of 40 to 60% 1,4-butadiene content. This butadiene microstructure is achieved during polymerization at 50° C. in cyclohexane containing about 6% by volume of diethylether or about 1000 ppm of glyme.

Anionic polymerization is terminated by addition of a functionalizing agent like those in U.S. Pat. No. 5,391,637, 5,393,843, and 5,418,296, which are also incorporated by reference, but preferably ethylene oxide, prior to termination.

The preferred di-lithium initiator is formed by reaction of two moles of sec-butyllithium with one mole of diisopropenylbenzene. This diinitiator is used to polymerize butadiene in a solvent composed of 90% w cyclohexane and 10% w diethylether. The molar ratio of diinitiator to monomer determines the molecular weight of the polymer. The living polymer is then capped with two moles of ethylene oxide and terminated with two moles of methanol to yield the desired polydiene diol.

The polydiene diol can also be made using a monolithium initiator that contains a hydroxyl group that has been blocked as the silyl ether as in U.S. Pat. Nos. 5,376,745 and 5,416,168, which are also incorporated by reference. A suitable initiator is hydroxypropyllithium in which the hydroxyl group is blocked as the trimethylsilyl ether. This mono-lithium initiator can be used to polymerize butadiene in hydrocarbon or polar solvent. The molar ratio of initiator to monomer determines the molecular weight of the polymer. The living polymer is then capped with one mole of ethylene oxide and terminated with one mole of methanol to yield the mono-hydroxy polydiene polymer. The silyl ether is then removed by acid catalyzed cleavage in the presence of water yielding the desired dihydroxy polydiene diol.

The polybutadiene diols are hydrogenated such that at least 90%, preferably at least 95%, of the carbon to carbon double bonds in the diols are saturated. Hydrogenation of these polymers and copolymers may be carried out by a variety of well established processes including hydrogenation in the presence of such catalysts as Raney Nickel, noble metals such as platinum and palladium, soluble transition metal catalysts and titanium catalysts as in U.S. Pat. No. 5,039,755 which is also incorporated by reference. A particularly preferred catalyst is a mixture of nickel 2-ethylhexanoate and triethylaluminum.

Chain extenders used herein can be reinforcing diols. The preferred reinforcing diol is a low molecular weight material having not more than two functional groups that will react with the diisocyanate. The number average molecular weight preferably is from 40 to 600, most preferably 60 to 120. The hydroxyl equivalent weight of the reinforcing diol will usually be between about 20 and about 300 grams per hydroxyl group, preferably between about 50 and 100 grams per hydroxyl group. If the reinforcing diol can be blended or cooked into the composition it is acceptable.

Reinforcing diols suitable for use in the present invention include aliphatic diols having 2, preferably 4, to 40 carbon such as ethylene glycol, 1,3-propane diol, 1,4-butane diol, 1,5-pentane diol, 1,6-hexane diol, 2-ethyl-1,3-hexane diol (PEP diol), 2,2,4-trimethyl-1,3-pentane diol (TMPD diol), and 2-ethyl-2-butyl-1,3-propane diol (BEPD diol). The most preferred chain extender is 1,4-butane diol.

The chain extender may be a blend of a diol and an amine having 2 to 40 carbon atoms. The preferred amine chain extenders are 1,2-ethylene diamine, 1,4-butane diamine, and 1,6-hexane diamine. Other examples of amine chain extenders are 4,4'-methylene bis(3-chloro-2,6-ethylaniline) available from Air Products Corporation, diethylene toluene diamine available from Ethyl Corporation and UNILINK 4100 and UNILINK 4200, both aromatic secondary amines available from UOP. (UNILINK is a trademark).

The amount of amine chain extender in the blend of diol and amine depends upon the resulting processibility of the polyurethane and the final physical properties. The diamine is included to build in some strong inter-chain associations. When the diamines are used as chain extenders they form urea linkages in the polymer chain. These tend to associate very strongly with each other and so polymers that are made using diamines exclusively are so strongly associated that they are not melt processible. The diamine is used to utilize these strong associations to get good hysteresis properties but at such a small level that the melt processing is not sacrificed. At low amine contents the resulting polyurethane retains its thermoplastic character. It has been found that when the amine content in the blended chain extender is 0.1 to 4.0 mol % of the total chain extender, thermoplastic polyurethanes with good physical properties result.

The isocyanate used in this invention is an isocyanate having an average functionality of two isocyanate groups per molecule. Examples of suitable diisocyanates are 2'4-toluene diisocyanate, 4,4'-diphenylmethane diisocyanate (MDI), mixtures of isomers of diphenylmethane diisocyanate, paraphenyldiisocyanate, isophorone-diisocyanate, bis(4-isocyanatocyclohexyl)-methane, naphthalene diisocyanate, and hexamethylene diisocyanate.

Blocked isocyanates made by reacting these diisocyanates and polyisocyanates with suitable blocking agents are also useful. Suitable blocking agents are phenols, alcohols such as butanol, hexanol, etc., oximes such as butanone oxime and caprolactam. The particular blocking agent used determines the temperature at which the blocking agent will deblock.

Specific commercially available isocyanates which can be used in this invention include those found in the following table:

| Designation | Chemical Identification | Eq. Wt. | Supplier |
|---|---|---|---|
| MONDUR M (MDI) | 1,4-diphenylmethane diisocyanate | 125 | Bayer AG |
| VESTANT (IPDI) | Isophorone diisocyanate | 111 | Huls |
| MONDUR, TD-80 (TDI) | Toluene diisocyanate | 87 | Bayer AG |
| DESMODUR W (HMDI) | Methylene bis (4-cyclo-hexyl-isocyanate) | 131 | Bayer AG |
| DESMODUR H (HDI) | 1,6-hexamethylene diisocyanate | 84 | Bayer AG |

(MONDUR, VESTANT and DESMODUR are trademarks)

A preferred way to make these polyurethanes is by the prepolymer method where the isocyanate component is reacted first with the polydiene diol to form an isocyanate terminated prepolymer, which can then be reacted further with the reinforcing diol of choice. The polyurethane compositions can be formulated to make elastomers using a solventless prepolymer method.

In the solventless prepolymer method, the polydiene diol is typically heated to at least 70° C. and not more than 100° C., and then mixed with the desired amount of diisocyanate for at least 30 minutes under nitrogen flow. The desired amount of chain extender is added and thoroughly mixed. The mixture is then cured; typically for several hours at 90 to 125° C. to form the polyurethane composition.

A second preferred way to make these polyurethanes is by the one-shot method. In this method the polydiene diol and chain extenders are mixed and heated to 90° C. to 100° C. The diisocyanate is heated separately to 70° C. to 80° C. The diisocyanate is introduced to the polydiene diol plus chain extenders and this multicomponent mixture is stirred vigorously for 1 minute. The reacting mixture is poured into a Teflon coated mold that is preheated to 105° C. and 20,000 psi pressure (138 MPa) and held in this condition for 1 hour. The resulting polyurethane is then post-cured at ambient pressure and 105° C. for 16 hours.

The polymerization process can be conducted in the presence of catalysts. Catalysts useful in accelerating the NCO/OH reaction are tertiary amines such as tetra-methyl butane diamine, and triethylamine, pyridine, 1,4-diaza(2,2,2)bicyclo-octane and organometallic compounds such as tin dioctoate and dibutyl tin dilaurate. These catalysts are used at levels ranging from 0.001% by weight to 1.0% by weight.

While the principal components of the melt processable elastomeric composition used to form the durable fibers have been described in the foregoing, such elastomeric composition is not limited thereto, and can include other components not adversely affecting the elastomeric composition attaining the stated objectives. Exemplary materials which could be used as additional components would include, without limitation, compatible thermoplastic elastomers, pigments, antioxidants, stabilizers, surfactants, waxes, flow promoters, solvents, particulates, and materials added to enhance processability and pellet handling of the composition.

EXAMPLES

Polyurethane polymers were synthesized using a solventless prepolymer process. The polymers of the current examples, which were based on the aliphatic diol, were synthesized using hydrogenated ethylene-butylene diol A from Shell Chemical. The hydroxyl equivalent weight of this polyol was 1660 g polyol/mol OH. A comparative polymer was synthesized using a polyester polyol, FORMREZ 6637, from Witco (FORMREZ is a trademark). The hydroxyl equivalent weight of this polyol was 1464 g polyol/mol OH. 4,4'-methylene bis(phenyl isocyanate) (MDI) was obtained from Aldrich Chemical. The MDI was stored in a freezer before use. The small amounts required for each polymerization was dispensed in a dry-box as needed. The chain extenders 1,4-butane diol and 1,2-ethylene diamine were obtained from Aldrich.

Polymer 1

400 g of aliphatic diol A was added to a 500 ml glass reactor. The diol was heated to 90° C. and stirred while the reactor was flushed with dry nitrogen over a 2 hour period. 59.88 g of solid MDI was then added and reacted with the diol for 90 minutes at 90° C. This urethane prepolymer was then poured from the reactor into a hot, dry glass bottle. 8.83 g of 1,4-butane diol was added to 375.56 g of prepolymer and stirred by an electric motor fitted with a JIFFY blade for 1–2 minutes (JIFFY is a trademark). The reacting polymer was then poured into a release coated aluminum pan and cured in vacuum at 95° C. for 16 hours. The resulting thermoplastic polyurethane elastomer is called Polymer 1. The hard segment content of this polyurethane was calculated according to equation 1. The resulting hard segment content of Polymer 1 was 15%.

Polymer 2

400 g of aliphatic diol A was added to a 500 ml glass reactor. The diol was heated to 90° C. and stirred while the reactor was flushed with dry nitrogen over a 2 hour period. 81.50 g of solid MDI was then added and reacted with the diol for 90 minutes at 90° C. This urethane prepolymer was then poured from the reactor into a hot, dry glass bottle. 16.48 g of 1,4-butane diol was added to 426.50 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 2. The resulting hard segment of this polymer was 20%.

Polymer 3

This polymer was composed of aliphatic diol A, MDI, and 1,4-butane diol and had a hard segment content of 20%. This polymer was made by a solution polymerization technique. In the first step a solventless prepolymer was made by heating the MDI and aliphatic diol to 80° C. for 90 minutes in a nitrogen-purged glass reaction. The prepolymer was then diluted with THF to form a 10% solids content solution. The solution was held at 60° C. The chain extender, 1,4-butane diol, and 0.1% by weight of polymer of a catalyst, stannous octoate, was added and the chain extension reaction was conducted for 3 hours. The polymer was then prepared for mechanical testing by casting from solution.

Polymer 4

400 g of aliphatic diol A was added to a 500 ml glass reactor. The diol was heated to 90° C. and stirred while the reactor was flushed with dry nitrogen over a 2 hour period. 134.00 g of solid MDI was then added and reacted with the diol for 90 minutes at 90° C. This urethane prepolymer was then poured from the reactor into a hot, dry glass bottle. 32.85 g of 1,4-butane diol was added to 468.87 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 4. The resulting hard segment of this polymer was 30%.

Polymer 5

200 g of aliphatic diol A was added to a 500 ml glass reactor. The diol was heated to 90° C. and stirred while the reactor was flushed with dry nitrogen over a 2 hour period. 40.97 g of solid MDI was then added and reacted with the diol for 90 minutes at 90° C. This urethane prepolymer was then poured from the reactor into a hot, dry glass bottle. 7.52 g of 1,4-butane diol was added to 200.88 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 5. The resulting hard segment of this polymer was 20%.

Polymer 6

200 g of aliphatic diol A was added to a 500 ml glass reactor. The diol was heated to 90° C. and stirred while the reactor was flushed with dry nitrogen over a 2 hour period. 41.00 g of solid MDI was then added and reacted with the diol for 90 minutes at 90° C. This urethane prepolymer was then poured from the reactor into a hot, dry glass bottle. A mixed chain extender was prepared separately and was composed of 89.1 g of 1,4-butane diol and 0.60 g of 1,2-ethylene diamine. This ratio of components corresponds to 1 mole % of 1,2-ethylene diamine in the mixed chain extender. 7.52 g of this mixed chain extender was added to 201.2 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 6. The resulting hard segment of this polymer was 20%.

Polymer 7

200 g of aliphatic diol A was added to a 500 ml glass reactor. The diol was heated to 90° C. and stirred while the reactor was flushed with dry nitrogen over a 2 hour period. 41.02 g of solid MDI was then added and reacted with the diol for 90 minutes at 90° C. This urethane prepolymer was then poured from the reactor into a hot, dry glass bottle. A mixed chain extender was prepared separately and was composed of 88.2 g of 1,1-butane diol and 1.20 g of 1,2-ethylene diamine. This ratio of components corresponds to 2 mole % of 1,2-ethylene diamine in the mixed chain extender. 7.69 g of this mixed chain extender was added to 206.31 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 7. The resulting hard segment of this polymer was 20%.

Polymer 8

200 g of aliphatic diol A was added to a 500 ml glass reactor. The diol was heated to 90° C. and stirred while the reactor was flushed with dry nitrogen over a 2 hour period. 41.06 g of solid MDI was then added and reacted with the diol for 90 minutes at 90° C. This urethane prepolymer was then poured from the reactor into a hot, dry glass bottle. A mixed chain extender was prepared separately and was composed of 86.4 g of 1,4-butane diol and 2.40 g of 1,2-ethylene diamine. This ratio of components corresponds to 4 mole % of 1,2-ethylene diamine in the mixed chain extender. 7.57 g of this mixed chain extender was added to 201.08 g of prepolymer and stirred by an electric motor fitted with a JIFFY blade for 1–2 minutes. The reacting polymer was then poured into a release coated aluminum pan and cured in vacuum at 95° C. for 16 hours. The resulting thermoplastic polyurethane elastomer is called Polymer 8. The resulting hard segment of this polymer was 20%.

Comparative Polymer A

Comparative polymer A was synthesized using a polyester polyol, FORMREZ 6637, from Witco. The hydroxyl equivalent weight of this polyol was 1464 g polyol/mol OH. The procedure used to make Polymer 1 was followed to react 323.6 g FORMREZ 6637, 76.36 g MDI and 17.59 g butane diol to form a 22.5% hard segment content thermoplastic polyurethane.

Comparative Polymer B

Comparative polymer B was ESTANE 58133, a commercially available polyurethane from B.F. Goodrich (ESTANE is trademark).

Comparative Polymer C

Comparative polymer C was TEXIN 985, a polyether based polyurethane commercially available from Bayer AG (TEXIN is a trademark).

Comparative Polymer D

The spandex fiber used here was DuPont's LYCRA 420, a commercially available solution spun fiber (LYCRA is a trademark).

Comparative Polymer E

Comparative polymer E was a styrene-ethylene/butylene-styrene block copolymer which was compounded with a processing oil and a polyolefin.

Immersion of Samples in Room Temperature Solvent

The polyurethane specimens were prepared according to ASTM D1708 for tensile testing. The tensile properties were measured on an INSTRON 4508 using a cross-head speed of 0.05 inches/minute (0.127 cm/min) (INSTRON is a trademark). Fresh samples were then immersed in the specified liquid for 21 days at room temperature. The tensile properties were measured again after immersion. The results are listed in Table 1.

TABLE 1

| | | Retention of mechanical property | | |
|---|---|---|---|---|
| Liquid | Polymer | Strength (%) | Elongation to break (%) | Modulus (%) |
| Concentrated Chlorox Bleach | 1 | 100 | 106 | 94 |
| | 2 | 108 | 131 | 107 |
| | Comparative A | 104 | 108 | 130 |
| | Comparative B | 0 | 0 | 0 |

TABLE 1-continued

| Liquid | Polymer | Retention of mechanical property | | |
|---|---|---|---|---|
| | | Strength (%) | Elongation to break (%) | Modulus (%) |
| Chlorox Bleach Fabric Dilution* | 1 | 106 | 113 | 92 |
| | 2 | 103 | 120 | 93 |
| | Comparative A | 122 | 107 | 119 |
| | Comparative B | 0 | 0 | 0 |
| Aqueous HCl (37%) | 1 | 94 | 83 | 106 |
| | 2 | 92 | 76 | 122 |
| | Comparative A | 0 | 0 | 0 |
| | Comparative B | 0 | 0 | 0 |

*(1 part bleach: 64 parts water by volume)

It can clearly be seen from the results above that the polyether-based and polyester-based polyurethanes are extremely sensitive to the solvent whereas the fibers made according to the present invention hold their properties extremely well under the same conditions.

Immersion of Samples in 70° C. Bleach

The same tests were performed on samples which had been immersed in bleach at 70° C. The results are shown in Table 2.

TABLE 2

| Liquid | Polymers | Retention of mechanical property | | |
|---|---|---|---|---|
| | | Strengths (%) | Elongation to break (%) | Modulus (%) |
| Concentrated Chlorox Bleach | 1 | 74 | 107 | 50 |
| | 2 | 54 | 100 | 44 |
| | Comparative A | 0 | 0 | 0 |
| | Comparative B | 0 | 0 | 0 |
| Chlorox Bleach Fabric Dilution* | 1 | 87 | 78 | 75 |
| | 2 | 57 | 78 | 60 |
| | Comparative A | 12 | 56 | 49 |
| | Comparative B | 23 | 15 | 33 |

*(1 part bleach: 64 parts water by volume)

It can clearly be seen from the results above that the polyether-based and polyester-based polyurethanes are extremely sensitive to the solvent whereas the fibers made according to the present invention hold their properties extremely well under the same conditions.

Elastic Recovery and Stress Relaxation Tests

Mechanical hysteresis tests were performed on the polyurethanes of the present invention and on comparative polymers. The properties are shown in Table 3.

Polymers 1, 2, 3 and 4, respectively, represent the present invention. Elastic properties of 1,4-butane-diol chain extended polymers with the three different amounts of hard segment component are shown here. Elastic properties of these samples were tabulated in Table 3. It is evident that polymers of this invention exhibit excellent elastic properties compared to the Comparative Polymers.

Extrudable compositions for each example were prepared from granules or pellets into elastic strings using heat and pressure. The strings were cut into 3-inch length test specimens. Test specimens for Spandex samples were cut from as received fiber strand. Elastic properties of the test specimens were determined utilizing a Constant Rate of Extension Tester, INSTRON Model 5565 Universal Testing Instrument. Each specimen was placed lengthwise in jaw faces, with a jaw span or separation of 1 inch (2.54 cm). The INSTRON tester crosshead speed was set at 10 inches per minute (25.4 cm/min) for the hysteresis test. In addition, stress relaxation was measured and determined as previously described.

TABLE 3

| Polymer | Examples of the Invention | | | | Comparative Examples | | | |
|---|---|---|---|---|---|---|---|---|
| | 1 | 2 | 3 | 4 | B | C | D | E |
| Stress Relaxation, 150% ext for 30' | | | | | | | | |
| % stress decay @ 23° C. | 46 | 48 | 44 | 49 | 54 | 47 | 38 | 30 |
| % stress decay @ 40° C. | * | 56 | 43 | * | 53 | 48 | 51 | 52 |
| Hysteresis to 160% ext | | | | | | | | |
| Peak stress, psi (MPa) | * | 405 (2.8) | 367 (2.5) | 349 (2.4) | 2281 (15.7) | 589 (4.8) | 489 (3.4) | 180 (1.2) |
| Stress @ 100% E loading, psi (MPa) | 344 (2.4) | 307 (2.1) | 276 (1.9) | 277 (1.9) | 1926 (13.3) | 600 (4.1) | 331 (2.3) | 162 (1.1) |
| Stress @ 100% E unloading, psi (MPa) | | 223 (1.5) | 216 (1.5) | 185 (1.3) | 403 (2.8) | 294 (2.0) | | 145 (1.0) |
| % Recovery | 72 | 67 | 73 | 58 | 20 | 42 | 67 | 68 |
| Permanent set, % | 13 | 18 | 15 | 28 | 52 | 27 | 8 | 12 |

* - Not measured

The heat resistance of compositions encompass in current invention is illustrated in the following examples. Test specimens obtained from Polymer 1 of the current invention and the Comparative Polymers D and E were immersed in boiling water for 30 minutes and then cooled. Stress relaxation and hysteresis tests as described in previous examples were conducted. Comparison of the properties before and after heat treatment are shown in Table 4.

While specimens of Comparative Polymer E compound broke upon being subjected to hot water treatment, specimens of the present invention not only survived the hot water treatment, but also exhibited the same elastic performance as before hot water treatment. In addition, the performance rivals Comparative Polymers D in this respect.

TABLE 4

| Polymer | Example of the Invention | | Comparative Examples | | | |
|---|---|---|---|---|---|---|
| Heat | 1 | | D | | E | |
| Treatment | Before | After | Before | After | Before | After |
| Stress Relaxation 150% ext for 30' | | | | | | Sample Broke |
| % stress decay @ 23° C. | 46 | 45 | 38 | 44 | 30 | — |
| Hysteresis to 150% | | | | | | Sample Broke |
| Peak Stress, psi (MPa) | 399 (2.8) | 416 (2.9) | 489 (3.4) | 461 (3.2) | 180 (1.2) | — |
| % Recovery | 72 | 73 | 67 | 65 | 68 | — |
| % Set | 13 | 13 | 8 | 8 | 12 | — |

Polyurethanes Composed of Mixed Chain Extenders

Polyurethanes 6, 7 and 8 were made with 1, 2 and 4 mol % 1,2-ethylene diamine (EDA) in the chain extender. The remainder of the chain extender was 1,4-butane diol. All of these polymers had a hard segment content of 20% by weight. These polyurethanes were thermoplastic. Specimens were prepared by melt pressing 10 mil (2.54–10-2 cm films at 200° C. The resulting tensile properties are shown in Table 5.

TABLE 5

| Polymer | Mol % EDA | Tensile Strength psi | Tensile Strength (MPa) | Elongation at break (%) |
|---|---|---|---|---|
| 5 | 0 | 2970 | (20.5) | 690 |
| 6 | 1 | 2040 | (14.1) | 470 |
| 7 | 2 | 1970 | (13.6) | 540 |
| 8 | 4 | 1130 | (7.8) | 510 |

The tensile properties demonstrate that strong, elastic polyurethanes which are thermoplastic can be made with as much as 4 mol % diamine in the chain extender mixture.

What is claimed:

1. A polyurethane elastomer comprised of (a) from 75 to 90% weight, basis the total of (a), (b) and (c), of a polydiene diol having up to about two terminal hydroxyl groups per molecule and a number average molecular weight between 1000 and 20,000, (b) from 9 to 24% weight, basis the total of (a), (b) and (c), of a diisocyanate, and (c) from 0.8 to 5% weight, basis the total of (a), (b) and (c), of a chain extender which is a mixture of a low molecular weight aliphatic diol and from 0.1 to 4.0 mol %, basis the total mixture, of a diamine

2. The polyurethane elastomer of claim 1 wherein the polydiene diol is a hydrogenated polybutadiene diol.

3. The polydiene diol of claim 2 wherein the 1,2-addition is from about 30 to about 70%.

4. The polydiene diol of claim 1 wherein the number average molecular weight is from about 1,000 to about 10,000.

5. The polydiene diol of claim 1 wherein the hydroxyl equivalent weight is from about 500 to about 10,000.

6. The polyurethane elastomer of claim 1 wherein the low molecular weight aliphatic diol is a linear aliphatic diol having 2 to 40 carbon atoms.

7. The polyurethane elastomer of claim 6 wherein the low molecular weight aliphatic diol is 1,4-butane diol.

8. The polyurethane elastomer of claim 1 wherein the chain extender is a mixture of the low molecular weight aliphatic diol and the diamine, wherein the diamine has a number average molecular weight in the range of from 46 to 600.

9. The polyurethane elastomer of claim 8 wherein the chain extender is a mixture of 1,4-butane diol and 1,2-ethylene diamine.

10. The polyurethane elastomer of claim 1 wherein the hard segment content is from about 10 to about 20% weight.

* * * * *